US008167515B2

(12) United States Patent
Hermes

(10) Patent No.: US 8,167,515 B2
(45) Date of Patent: May 1, 2012

(54) HOT-ROLLED STRAIGHT-WEB STEEL SHEET PILE

(75) Inventor: Aloyse Hermes, Differdange (LU)

(73) Assignee: Arcelormittal Belval & Differdange, De La Liberte (LU)

( * ) Notice: Subject to any disclaimer, the term of this patent is extended or adjusted under 35 U.S.C. 154(b) by 452 days.

(21) Appl. No.: 11/565,341

(22) Filed: Nov. 30, 2006

(65) Prior Publication Data

US 2007/0127991 A1 Jun. 7, 2007

(30) Foreign Application Priority Data

Dec. 1, 2005 (EP) ..... 05111583

(51) Int. Cl.
*E02D 17/00* (2006.01)

(52) U.S. Cl. ..... 405/278; 405/276

(58) Field of Classification Search ..... 405/274, 405/276, 277, 278, 283
See application file for complete search history.

(56) References Cited

U.S. PATENT DOCUMENTS

| | | | | | |
|---|---|---|---|---|---|
| 756,618 | A * | 4/1904 | Priestedt | 405/277 |
| 912,021 | A * | 2/1909 | Neilson | 405/278 |
| 923,110 | A * | 5/1909 | Boardman | 405/278 |
| 965,157 | A * | 7/1910 | Conkling | 405/278 |
| 968,450 | A * | 8/1910 | Conkling et al. | 405/278 |
| 1,012,124 | A * | 12/1911 | Conkling | 405/278 |
| 1,338,287 | A * | 4/1920 | Conkling | 405/278 |
| 1,888,968 | A * | 11/1932 | Mauterer | 405/278 |
| 2,004,188 | A * | 6/1935 | Borberg | 405/278 |
| 2,128,740 | A * | 8/1938 | Dougherty | 405/281 |
| 3,688,508 | A * | 9/1972 | Taylor | 405/278 |
| 5,066,353 | A * | 11/1991 | Bourdo | 156/300 |
| 5,333,971 | A * | 8/1994 | Lewis | 405/281 |
| 6,190,093 | B1 * | 2/2001 | Bastian et al. | 405/278 |
| 6,715,964 | B2 | 4/2004 | Nottingham | |
| 7,008,142 | B2 * | 3/2006 | Moreau | 405/281 |
| 7,500,808 | B2 * | 3/2009 | Dettmer et al. | 405/276 |

FOREIGN PATENT DOCUMENTS

| | | |
|---|---|---|
| DE | 571 720 | 3/1933 |
| GB | 516 106 | 12/1939 |
| JP | 55138511 A | 10/1980 |
| JP | 56020227 A | 2/1981 |

* cited by examiner

*Primary Examiner* — Tara Mayo-Pinnock
(74) *Attorney, Agent, or Firm* — Woodward, Ermhardt, Moriarty, McNett & Henry LLP

(57) ABSTRACT

The hot-rolled straight-web steel sheet pile comprises a straight web delimited on each longitudinal side respectively by an interlock strip. The web has a rolled-in taper which is designed in such a way that, in a tensile test of two samples from this sheet pile which are connected by means of their interlock strips, the web is deformed plastically in the region of this taper before a failure of the interlock connection can occur. The rolling of such a sheet pile, which is distinguished in cellular cofferdams by a high plastic deformation capacity, can take place by means of slightly modified standard rolls and consequently requires no major investment.

33 Claims, 2 Drawing Sheets

HOT-ROLLED STRAIGHT-WEB STEEL SHEET PILE

TECHNICAL FIELD OF THE INVENTION

The present invention relates to a hot-rolled straight-web steel sheet pile, in particular for the construction of cellular cofferdams.

BACKGROUND OF THE INVENTION

The first hot-rolled straight-web steel sheet piles, also referred to as straight sheet piles, were already in use in the USA at the end of the 19th century. In Europe, these straight sheet piles have been rolled since the thirties of the 20th century. They comprise a straight web which lies in the wall axis and is delimited on each longitudinal side by an interlock strip. The individual straight sheet piles can be connected into a continuous sheet pile wall by means of these interlock strips.

Straight sheet piles are used particularly for the construction of cellular cofferdams without internal anchoring. Depending on the shape of the cells, a distinction is made between circular or straight cellular cofferdams. In the U.S.A., straight sheet piles have also been used for the construction of so called "open cells" (see, for example, U.S. Pat. No. 6,715,964). Closed and open cells are designed in such a way that the loads originating from the filling and water overpressure produce in the straight sheet piles only tensile stress in the direction of an horizontal wall axis.

In the dimensioning of the straight sheet piles for such cellular cofferdams, the stress (for example, the ring tensile force determined by means of the "boiler formula") is compared with the sheet pile resistance. The latter is obtained, according to EN 1993-5, as the minimum arising from a failure in the interlock and a creep (i.e. a plastic deformation) in the web.

However, the manufacturer selects the steel quality for the web traditionally in such a way that the following condition is fulfilled:

$$(f_y \cdot t)/S_1 > R/S_2 \rightarrow f_y > (R \cdot S_1)/(t \cdot S_2) \quad (1)$$

in which:

$f_y$=the nominal yield point;

t=the web thickness;

R=the minimum interlock tensile strength guaranteed by the manufacturer (for example, R=5500 kN/m);

$S_1$=a safety coefficient for the creep in the web;

$S_2$=a safety coefficient for the failure in the interlock;

the safety coefficients being different for the two types of failure, for example:

$S_1$=1.0 (creep in the web);

$S_2$=1.25 (failure in the interlock).

Adhering to the condition (1) given above ensures that the creep in the web will never be critical under tensile load on the straight sheet piles, that is to say that only the minimum interlock tensile strength R guaranteed by the manufacturer has to be respected. As a result, a failure of a straight sheet pile connection is almost always attributable to a breaking-open of an interlock connection.

A breaking-open of an interlock connection in the cell wall of a cofferdam cell causes a discontinuity in the absorption of the ring tensile forces. This results in a gap in the cell wall, which becomes enlarged and through which the soil filling of the cofferdam cell is flushed away. Without sufficient soil filling, however, the cofferdam cell can no longer withstand the loads originating from the water overpressure, which will inevitably result in a failure of the cofferdam.

Almost all straight sheet piles have symmetrical interlock strips of the "thumb and finger" type which, rotated through 180°, hook together with one another. In the case of two interlock strips locked together, the two thumbs engage one behind the other, the fingers respectively surrounding the thumb of the opposite interlock strip (see FIG. 1). A failure of such an interlock connection takes place either due to the tearing-off of the thumb subjected to tensile stress or due to the opening or breakage of the finger subjected to bending stress.

For reasons of cost, all manufacturers of straight sheet piles have in their standard delivery range only three to four straight sheet piles which differ from one another essentially in the thickness of their web. As a rule, web thicknesses of 11 to 13 mm are implemented in such straight sheet piles. The selection of the steel quality then determines the minimum interlock tensile strength of the web, wherein, as a rule, values of 2000-4000 kN/m being ensured. New high-strength steels, such as, for example, the steel S 460 GP, make it possible to ensure even a minimum interlock tensile strength of 5500 kN/m. Since an increased steel quality also leads to an increase in the yield point in the web, it is always warranted that the condition (1) remains fulfilled. It will also be appreciated in this context that straight sheet piles with a thicker web have, as a rule, a higher minimum interlock tensile strength, since, during the rolling of a thicker web, the parts of the interlock which are critical for the interlock tensile strength can also be rolled more thickly.

It sometime happens that the manufacturer cannot achieve the minimum interlock tensile strength required for the construction project with straight sheet piles from the standard delivery program. For reasons of cost, however, a manufacturer is hardly prepared to roll special straight sheet piles for individual construction projects. In such instances, it is known to increase the minimum interlock tensile strength of webs from the standard delivery program in that, starting from an existing calibration, the "calibre" is opened further during the rolling operation, that is to say the gap set between the upper and lower roll is slightly increased. As a result, not only does the web become slightly thicker, but the parts of the interlock which are critical for the interlock tensile strength are also of stronger design and consequently afford higher resistance. Such a method is described, for example, in JP55138511. It should be noted that this procedure also ensures that the condition (1) remains fulfilled.

For the purpose of increasing the interlock tensile strength, it has likewise been proposed to vary the geometry of the interlock strips (see, for example, JP56020227). However, for this purpose the manufacturer would have to invest in new rolls. Furthermore, he would subsequently have to include in his delivery program two different interlock types for straight sheet piles, which does not exactly simplify the logistics. For both reasons, the manufacturers of straight sheet piles are therefore hardly prepared to follow this path.

It has also been known for a long time that straight sheet piles may also be exposed to high dynamic loads in specific cofferdams. The walls of the cells are, for example, rammed by ships and, in the case of spring tides and storm tides, are exposed to the impact of heavy drift flotsam. Moreover, many cofferdams are also erected in earthquake zones. For such dynamic load situations, the straight sheet piles would actually have to be designed in a completely different way from hitherto. Thus, for example, it would have to be ensured that the straight sheet piles can absorb substantially higher deformation energy than hitherto before the failure of an interlock connection occurs. However, since it has been assumed that major investments are required for the production of such a completely new straight sheet pile, no manufacturer has hitherto put on the market a straight sheet pile which is designed particularly for the dynamic load situations mentioned above.

The present invention is based on the surprising finding that a straight sheet pile from the standard delivery range of a manufacturer can be modified at very low outlay in such a way that it is substantially more suitable for the absorption of dynamic stresses.

BRIEF SUMMARY OF THE INVENTION

According to the present invention, this object is achieved in that a taper is rolled into the web of the straight sheet pile and designed in such a way that, in a tensile test of two samples from this sheet pile, which are connected by means of their interlock strips, the web is deformed plastically in the region of this taper before a failure of the interlock connection can occur. It will be appreciated that by simply rolling a taper into the web, which can be achieved by means of an only slightly modified set of rolls used for rolling straight sheet piles of the standard program, i.e. without major investment in new roll stands, a straight sheet pile can be produced which, in contrast to known straight sheet piles, has a pronounced plastic work capacity in a sheet pile wall. Owing to this pronounced plastic work capacity, a sheet pile wall built with straight sheet piles according to the invention is substantially more suitable for the absorption of dynamic stresses and can be used particularly advantageously in cofferdams which are exposed, for example, to the following risks: ramming by ships, the impact of heavy drift flotsam during storm tides and spring tides, and also earthquakes. In the cell wall, the webs of the sheet piles according to the present invention can absorb a significant deformation energy under such loads, without a breaking-open of an interlock connection occurring.

In order to achieve the desired effect, the web is preferably to be designed for a nominal failure load which is less than 90% of the guaranteed minimum tensile strength of the interlock strips. In a tensile test of two samples from this sheet pile which are connected by means of their interlock strips, a plastic displacement distance of at least 1% of the overall width of the sheet pile is then to be measured for the web.

The taper is preferably to be designed symmetrically with respect to the center line of the web, so that it has the same distance from both interlock strips. It advantageously forms a central portion with a width B and with a constant thickness t, wherein t is the minimum thickness of the web. The width B preferably amounts to between 5% and 80% of the overall width W of the web. Good results are normally achieved even with a width B of between 30 and 100 mm. Alternatively, the thickness of the taper may decrease continuously as far as the center line of the web, and the minimum thickness of the web may then be achieved only on the center line of the web.

The web advantageously has its maximum thickness in the connection region of the interlock strips. It advantageously has, for example, along each interlock strip a portion with a width $b_0$ and with a constant thickness $t_0$, $t_0$ being the maximum thickness of the web. Normally, $t_0$ will amount to 13 to 14 mm.

The taper advantageously has a convexly cylindrical surface with a radius $R_1$, which has adjoining it towards the center line of the web a concavely cylindrical surface with a radius $R_2$, wherein $R_2$ is substantially larger than $R_1$, and is larger by a multiple than the nominal width of the sheet pile.

Further features and advantages of the invention may be derived from the following description of a preferred embodiment of the invention and the accompanying drawings.

BRIEF DESCRIPTION OF THE DRAWINGS

The accompanying drawings show a preferred, but not exclusive embodiment of the invention, wherein.

DETAILED DESCRIPTION OF THE INVENTION

Figure 1:
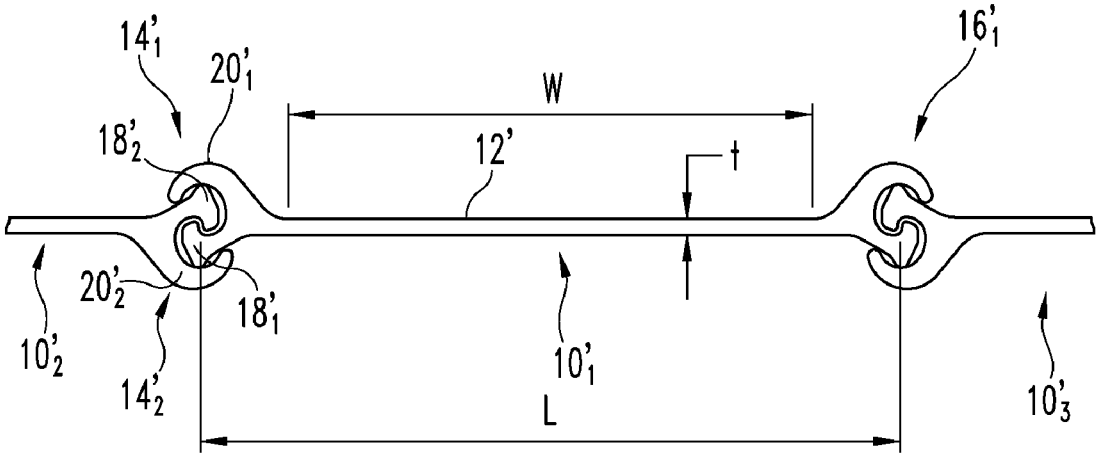
Fig. 1 (PRIOR ART)
FIG. 1 is a cross section through three hooked-together straight-web steel sheet piles from the standard delivery program of a manufacturer.

FIG. 1 shows hot-rolled straight-web steel sheet piles $\mathbf{10'}_1$, $\mathbf{10'}_2$ and $\mathbf{10'}_3$, such as have been put on the market for decades by various manufacturers. Such a straight sheet pile $\mathbf{10'}_1$ comprises a straight web 12' and two symmetrical interlock strips $\mathbf{14'}_1$, $\mathbf{16'}_1$. The latter are of the "thumb and finger" type and delimit the web 12' on its two longitudinal sides.

The dimensions of such a straight sheet pile are basically defined, as shown in FIG. 1: the nominal width of the straight sheet pile $\mathbf{10'}_1$ being designated by "L", the width of its web by "W" and the thickness of its web by "t". Straight sheet piles from the current delivery program of the manufacturers have, for example, a nominal width of 500 mm, a web thickness of 11 to 13 mm and a delivery length of more than 30 m.

As is evident from FIG. 1, the straight sheet piles 10' are arranged, alternately rotated through 180°, in a sheet pile wall and are hooked together with their interlock strips 14', 16'. In the case of two hooked-together interlock strips $\mathbf{14'}_1$, $\mathbf{14'}_2$, the two thumbs $\mathbf{18'}_1$, $\mathbf{18'}_2$ engage one behind the other, the fingers $\mathbf{20'}_1$, $\mathbf{20'}_2$ respectively surrounding the thumbs $\mathbf{18'}_2$, $\mathbf{18'}_1$ of the opposite interlock strip.

Such straight sheet piles are used particularly for the construction of cellular cofferdams without internal anchoring. A distinction is made between circular or straight cellular cofferdams, depending on the shape of the cells. In the U.S.A., such straight sheet piles have also been used for the construction of so called "open cells" (see, for example, U.S. Pat. No. 6,715,964). These straight sheet piles are subjected to tensile stress primarily in the direction of the horizontal cell extent. As already mentioned in the introduction, all known straight sheet piles are designed such that no plastic deformation of the web occurs until the minimum interlock tensile strength guaranteed by the manufacturer is reached, that is to say until the failure of an interlock connection.

Figure 2:
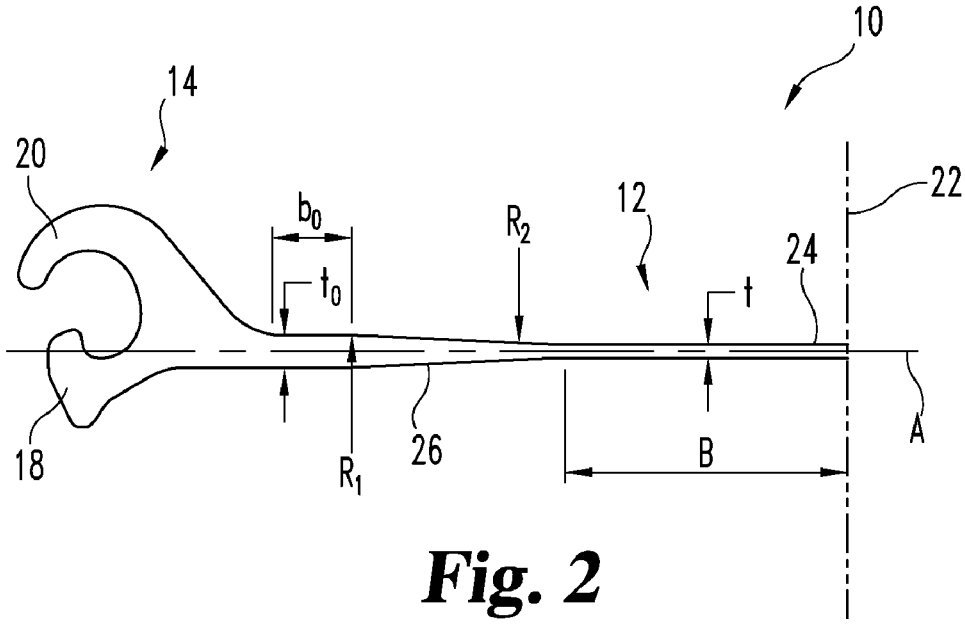
FIG. 2 shows a cross section through a straight-web steel sheet pile according to the invention, only the left half of the sheet pile being shown.

FIG. 2 shows the left half of a straight sheet pile 10 according to the invention. Like the known straight sheet piles from FIG. 1, the latter likewise comprises a substantially straight web 12 and two symmetrical interlock strips of the "thumb and finger" type which delimit the web 12 on its two longitudinal sides. Reference symbol 22 designates the mid-plane of sheet pile 10 which at the same time is also a plane of symmetry of the sheet pile 10. The straight sheet pile 10 has the same width and the same interlock strips as the straight sheet piles 10'. Web 12 lies on axis A that extends through interlocks 14. In the illustrated embodiment, axis A is also the neutral axis of web 12.

In contrast to the above-described standard straight sheet piles 10' of FIG. 1, however, the sheet pile 20 of FIG. 2 is designed in such a way that the nominal failure load of the web is less than 90% of the minimum tensile strength of the interlock strips, so that, in a tensile test of two sheet piles connected by means of their interlock strips 14, the web is deformed plastically before the interlock strips 14 can give way. This is achieved in that tapered portions 26 are rolled into the web 12, so that the web 12 has a central web portion 24 with a reduced thickness that is deformed plastically before a failure of an interlock connection can occur.

Dimensioning Example of the Novel Sheet Pile:

The straight sheet pile shown was designed for a minimum interlock tensile strength of R=6000 kN/m. In order to achieve this relatively high minimum interlock tensile strength, a steel quality S 460 GP with a nominal yield point $f_y$=460 MPa and with a nominal failure stress of $f_u$=530 MPa was selected. Furthermore, the web thickness $t_0$ was increased slightly in the connection region of the interlock strips 14, as compared with a standard straight sheet pile having the same nominal width.

In order to ensure that the tapered web 12 is deformed plastically before the interlock strips 14 give way, the nominal failure load of the web was limited to 85% of the guaranteed interlock tensile strength. This results in a web thickness t in the region of the central web portion 24 of:

$$t>/f_u \Rightarrow t>9.6 \text{ mm} \quad (2)$$

Finally, a minimum web thickness t of 9.5 mm was selected for the central web portion 24.

This minimum thickness t is constant with a width B in a central web portion 24, this width B advantageously amounting to at least 5% of the overall width W of the web 12. This central web portion 24 with the minimum thickness t absorbs the plastic deformation of the web after the yield point is overshot. The larger the width B is, the greater is the plastic work capacity of the straight sheet pile, that is to say the more the web can expand in width before it ultimately fails. In order to be able to easily roll the slightly thickened interlock strips 14 by means of an only slightly modified set of rolls, sufficiently wide web edges with an increased thickness $t_0$ should remain. Furthermore, it should be noted in this respect that too large a width B may lead to instabilities when the straight sheet pile is driven in. Moreover, it is also important to limit the plastic deformation in order to avoid damage to the secondary structure. Beyond a defined deformation, the straight sheet piles should in this case avoid further load absorption, in order thereby to initiate a shift operation. For these reasons, therefore, the width B in the central web portion 24 should not be too large and basically should be no larger than 80% of the overall width W of the web 12. Initial tensile tests also confirmed that even a width B of approximately 30-60 mm for the central web portion 24 with a minimum thickness t would seem to increase the plastic work capacity of the sheet pile 10 sufficiently for many applications. A substantially lower plastic work capacity is achieved by means of a web having a thickness that decreases continuously as far as the center line 22 of the web 12, so that the web reaches its minimum thickness t only on the center line of the web (that is to say, B≈0).

In the tapered portion 26 from the central web portion 24 having the minimum thickness t to the thickened web edges having the thickness $t_0$, the web 12 advantageously has a convexly cylindrical surface with a radius $R_1$ which has adjoining it towards the center line of the web a concavely cylindrical surface with a radius $R_2$. The radius $R_2$ is in this case substantially larger than the radius $R_1$ and is larger by a multiple than the nominal width L of the sheet pile.

It should be noted that the straight sheet pile 10 of FIG. 2 can be rolled with only slight modifications by means of the same roll stand which is used for rolling the standard webs with a constant web thickness. For this purpose, an existing pair of rolls, by means of which normally straight sheet piles with a standard range are rolled, needs to be lathe-turned only slightly, which certainly requires no major investment.

Figure 3:
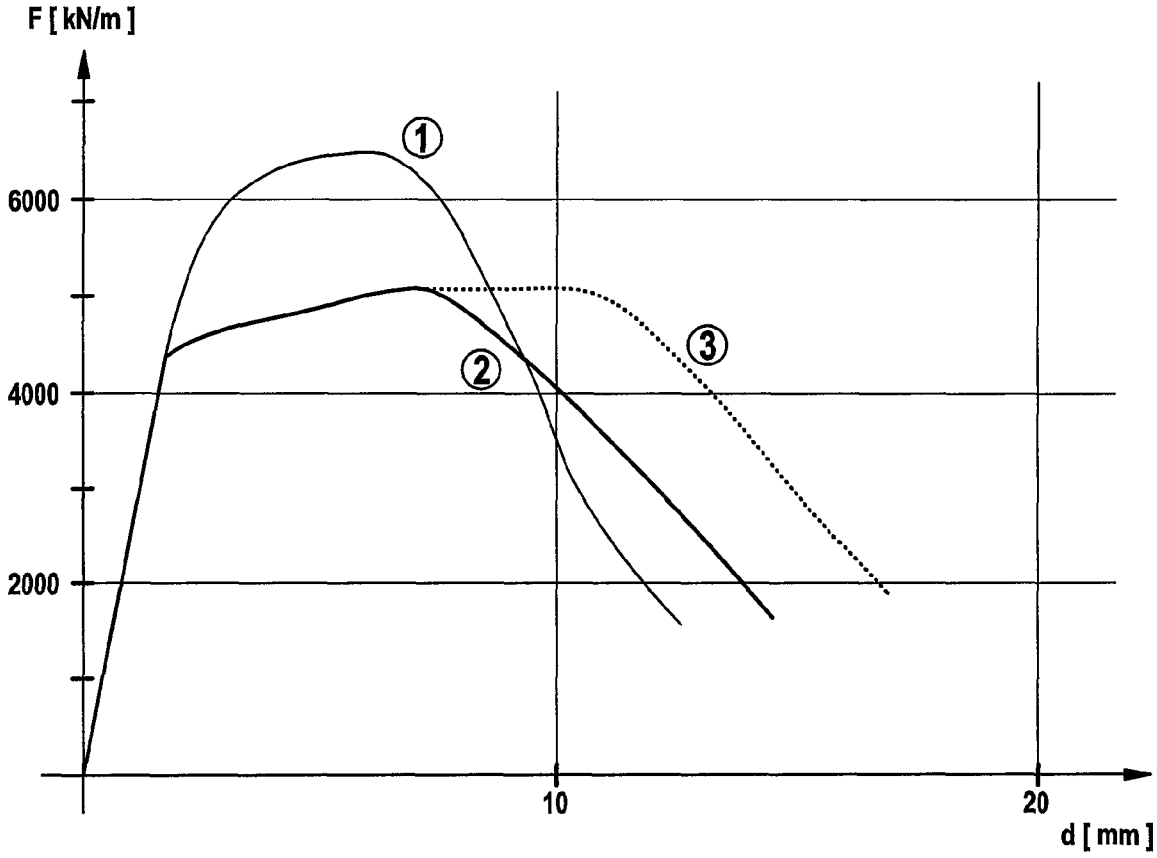
FIG. 3 is a graph which reproduces the load/displacement curves for a standard straight sheet pile and for two types of straight sheet piles according to the invention.

For the purpose of a further explanation of the typical properties of the straight sheet piles according to the invention, the graph in FIG. 3 shows representative load/displacement curves for three different straight sheet piles. These curves were recorded in path-controlled tensile tests according to prEN 12048. The test candidates differed from one another only in the shape of the web and all had a steel quality S 460 GP with a nominal yield point $f_y$=460 MPa and with a nominal failure stress of $f_u$=530 MPa.

The curve 1 is the load/displacement curve for a connection of two samples from a standard straight sheet pile with a constant web thickness of 13 mm. It can be seen that, although this connection achieves a tensile load of more than 6000 kN/m, it starts to become unstable already with a relative displacement of 5 mm. The failure of the connection ultimately occurs due to a tearing-open of the interlock connection.

The curve 2 is the load/displacement curve for a connection of two samples from a straight sheet pile in which the thickness of the web decreases continuously from a value of 13.5 m in the vicinity of the interlock strips as far as the center line of the web and a minimum thickness of the web of 9.5 mm is achieved on the center line of the web. It can be seen that this connection achieves a maximum tensile load of 4500 kN/m, but that it becomes unstable only after a relative displacement of more than 7 mm. The failure of the connection is in this case preceded by a pronounced plastic displacement distance of approximately 5 mm. This plastic displacement distance thus amounts to approximately 1% of the overall width of the straight sheet pile 10.

The curve 2 is the load/displacement curve for the connection of two samples from a straight sheet pile according to FIG. 2 in which $t_0$=13.5 mm, $t_0$=13.5 mm, t=9.5 mm and B=40 mm. This connection, too, achieves a maximum tensile load of 4500 kN/m. However, the failure of the connection is preceded by a plastic displacement of almost 10 mm, so that it can absorb relative displacement of almost 12 mm in the tensile direction, without the opening of the interlock connection occurring. The plastic displacement distances in this case amount to 2% of the overall width of the straight sheet pile 10.

Owing to their high plastic deformation capacity, straight sheet piles according to the invention are pre-eminently suitable for use in cofferdams which may be rammed by ships, which are to withstand the impact of drift flotsam in spring tides and storm tides and/or which are to be erected in earthquake zones. The risk of the tearing-open of an interlock connection and therefore the risk of a run-out of the filling of a cofferdam cell is appreciably reduced by means of the straight sheet piles according to the invention.

Last but not least, the novel straight sheet piles in accordance with the present invention are particularly useful because they can be produced on an existing roll stand having an only slightly modified set of rolls. The necessary investment is therefore negligible, as compared with a new straight sheet pile with a constant web thickness and with a modified claw geometry.

I claim:

1. A hot-rolled straight-web steel sheet pile, comprising:

a web delimited on each longitudinal side by an interlock strip, wherein the web lies on an axis extending through said interlock strips and extends between the interlock strip on each longitudinal side in a straight fashion without bends or curves;

wherein said web has a rolled-in taper resulting in a reduced web thickness which is designed in such a way that, in a tensile test of two samples from said sheet pile that are connected by means of their interlock strips, said web is plastically deformed in the region of said reduced web thickness before a failure of the interlock connection can occur.

2. The sheet pile according to claim 1, wherein:

a minimum tensile strength is guaranteed for said interlock strips, and said web has a nominal failure load which is less than 90% of said minimum tensile strength of said interlock strips.

3. The sheet pile according to claim 1, wherein:

in a tensile test of the sheet pile loaded by means of the interlock strips, a plastic displacement distance of at least 1% of the nominal width of said sheet pile is measured for said web.

4. The sheet pile according to claim 1, wherein said web has two rolled-in tapered portions designed symmetrically with respect to the center line of said web.

5. The sheet pile according to claim 4, wherein said web has a central portion with a width and with a constant thickness, and this thickness is the minimum thickness of said web.

6. The sheet pile according to claim 5, wherein said web has an overall width and said width of said central portion amounts to between 5% and 80% of said overall width of said web.

7. The sheet pile according to claim 6, wherein said width of said central portion has a value of between 30 mm and 100 mm.

8. The sheet pile according to claim 1, wherein said web has its maximum thickness in the connection region of said interlock strips.

9. The sheet pile according to claim 1, wherein the thickness of said taper decreases continuously up to the center line of said web, and the minimum thickness of said web is achieved on the center line of said web.

10. The sheet pile according to claim 9, wherein said web has its maximum thickness in the connection region of said interlock strips.

11. The sheet pile according to claim 1, wherein said web has along each interlock strip a portion with a width and with a constant thickness, and this constant thickness is the maximum thickness of said web.

12. The sheet pile according to claim 1, wherein said taper has a convexly cylindrical surface with a first radius, to which adjoins, towards the center line of said web, a concavely cylindrical surface with a second radius, the second radius being larger than the first radius and being larger than the nominal width of said sheet pile.

13. The sheet pile according to claim 1, which is designed in such a way that a minimum interlock tensile strength of at least 5500 KN/m is guaranteed.

14. The sheet pile according to claim 13, wherein said interlock strips comprise symmetrical thumb and finger interlocks.

15. The sheet pile according to claim 14, wherein the symmetrical thumb and finger of said interlock strips are located on opposite sides of the axis.

16. The sheet pile according to claim 1, wherein said interlock strips comprise symmetrical thumb and finger interlocks.

17. The sheet pile according to claim 16, wherein the symmetrical thumb and finger of said interlock strips are located on opposite sides of the axis.

18. The sheet pile according to claim 1, wherein the straight web lies on the neutral axis of the sheet pile.

19. The sheet pile according to claim 1, wherein the web extends between the interlock strip on each longitudinal side in a straight fashion without bends or curves.

20. The sheet pile according to claim 1, wherein the taper is constructed and arranged to result in a plastic displacement distance of at least 1% of the nominal width of the sheet pile before any portion of the sheet pile fails when stressed in tension between the interlock strips.

21. A hot-rolled straight-web steel sheet pile, comprising:

a straight web that lies on the neutral axis of the sheet pile and has an overall width between two longitudinal sides, rolled-in taper portions and a central portion of the web with a constant thickness a width that amounts to between 5% and 80% of said overall width; and an interlock strip along each of said two longitudinal sides of said web;

wherein said central portion is designed in such a way that, in a tensile test of two samples from said sheet pile that are connected by means of their interlock strips, said web is plastically deformed in said central portion of said web before a failure of said interlock connection can occur.

22. The sheet pile according to claim 21, wherein a minimum tensile strength is guaranteed for said interlock strips, and said web has a nominal failure load which is less than 90% of said minimum tensile strength of said interlock strips.

23. The sheet pile according to claim 22, which is designed in such a way that a minimum interlock tensile strength of at least 5500 KN/m is guaranteed.

24. The sheet pile according to claim 21, wherein, in a tensile test of two samples from said sheet pile that are connected by means of their interlock strips, a plastic displacement distance of at least 1% of the nominal width of said sheet pile is measured for said web.

25. The sheet pile according to claim 21, wherein said constant thickness of said central portion is the minimum thickness of said web.

26. The sheet pile according to claim 21, wherein the straight web lies on an axis extending through said interlock strips.

27. A straight-web sheet pile for the construction of cellular cofferdams without internal anchoring, the straight-web steel sheet pile comprising:

a straight web delimited on each longitudinal side by an interlock strip, wherein the straight web and interlock strips are constructed and arranged to construct a cellular cofferdam without internal anchoring, wherein the straight web extends between the interlock strip on each longitudinal side in a straight fashion without bends or curves and wherein the straight web and interlock strips are primarily stressed in tension in the direction of an horizontal wall axis when assembled in the cellular cofferdam without internal anchoring; and a central portion of the web delimited on each longitudinal side by tapered portions in the straight web constructed and arranged such that, when the straight-web sheet pile is loaded in tension along the horizontal wall axis, the central portion plastically deforms at a lower tensile load than required to fail an interlock connection by the interlock strips.

28. The sheet pile according to claim 27, wherein the central portion is constructed and arranged to result in a plastic displacement distance of at least 1% of the nominal width of the sheet pile before any portion of the sheet pile fails in tensile loading when loaded in tension by the interlock strips.

29. The sheet pile according to claim 27, wherein the central portion has a width with a constant thickness that is the minimum thickness of the web.

30. The sheet pile according to claim 29, wherein the web has along each interlock strip a portion with a width and with a constant thickness that is the maximum thickness of the web.

31. The sheet pile according to claim 27, wherein the web lies on an axis extending through the interlock strips.

32. A hot-rolled straight-web steel sheet pile, comprising:

a web delimited on each longitudinal side by an interlock strip, wherein the web extends between the interlock strip on each longitudinal side in a straight fashion without bends or curves;

wherein said web has a rolled-in taper resulting in a reduced web thickness which is designed in such a way that, in a tensile test of two samples from said sheet pile that are connected by means of their interlock strips, said web is plastically deformed in the region of said reduced web thickness before a failure of the interlock connection can occur.

33. A hot-rolled straight-web steel sheet pile, comprising:

a straight web having an overall width between two longitudinal sides and a rolled-in taper portion and a central portion of the web with a constant thickness width that amounts to between 5% and 80% of said overall width; and an interlock strip along each of said two longitudinal sides of said web, said web extending between said interlock strips in a straight fashion without bends or curves; wherein said central portion is designed in such a way that, in a tensile test of two samples from said sheet pile that are connected by means of their interlock strips, said web is plastically deformed in said central portion of said web before a failure of said interlock.

* * * * *